US010113384B2

(12) United States Patent
Nguyen

(10) Patent No.: US 10,113,384 B2
(45) Date of Patent: Oct. 30, 2018

(54) MULTI-METAL SEAL SYSTEM

(71) Applicant: Cameron International Corporation, Houston, TX (US)

(72) Inventor: Dennis P. Nguyen, Pearland, TX (US)

(73) Assignee: Cameron International Corporation, Houston, TX (US)

( * ) Notice: Subject to any disclaimer, the term of this patent is extended or adjusted under 35 U.S.C. 154(b) by 294 days.

(21) Appl. No.: 14/645,313

(22) Filed: Mar. 11, 2015

(65) Prior Publication Data

US 2016/0265298 A1 Sep. 15, 2016

(51) Int. Cl.

| | |
|---|---|
| ***E21B 33/03*** | (2006.01) |
| ***E21B 33/04*** | (2006.01) |
| ***E21B 23/00*** | (2006.01) |
| ***E21B 43/12*** | (2006.01) |

(52) U.S. Cl.

CPC ..... *E21B 33/04* (2013.01); *E21B 23/00* (2013.01); *E21B 43/121* (2013.01)

(58) Field of Classification Search

CPC ..... E21B 33/04; E21B 23/00; E21B 43/121
USPC ..... 277/328; 166/379, 368, 75.13
See application file for complete search history.

(56) References Cited

U.S. PATENT DOCUMENTS 4,030,544 A * 6/1977 Ahlstone ..... E21B 33/043 166/182
4,408,783 A * 10/1983 Gruller ..... E21B 33/043 166/217
4,556,224 A 12/1985 Le
4,750,559 A * 6/1988 Greenlee ..... E21B 23/01 166/216
4,771,832 A * 9/1988 Bridges ..... E21B 33/0422 166/380
5,325,925 A * 7/1994 Smith ..... E21B 33/04 166/196
8,146,670 B2 * 4/2012 Ellis ..... E21B 33/04 166/368

(Continued)

FOREIGN PATENT DOCUMENTS

GB 2108598 A 5/1983
WO 2014/038956 A1 3/2014

OTHER PUBLICATIONS

PCT International Search Report and Written Opinion; Application No. PCT/US2016/019197; dated May 4, 2016; 13 pages.

(Continued)

*Primary Examiner* — Nathan Cumar
(74) *Attorney, Agent, or Firm* — Fletcher Yoder, P.C.

(57) ABSTRACT

A system including a first tubular, a second tubular configured to rest within a bore of the first tubular, a multi-metal seal system configured to seal a space between the first tubular and the second tubular, wherein the multi-metal seal system includes, a first metal seal portion with a first angled surface and a second angled surface, a second metal seal portion with a third angled surface, and a third metal seal portion with a fourth angled surface, wherein the first angled surface selectively engages the third angled surface at a first angled interface and the second angled surface selectively engages the fourth angled surface at a second angled interface, and wherein the first and second angled interfaces are configured to drive the first metal seal portion radially away from the second and third metal seal portions.

20 Claims, 10 Drawing Sheets

(56) References Cited

U.S. PATENT DOCUMENTS

| | | | | |
|---|---|---|---|---|
| 2010/0126736 | A1* | 5/2010 | Ellis | E21B 33/04 166/387 |
| 2011/0169224 | A1* | 7/2011 | Nguyen | E21B 33/03 277/314 |

OTHER PUBLICATIONS

Singapore Written Opinion for SG Application No. 11201707430Y dated Jul. 30, 2018; 9 pgs.

* cited by examiner

MULTI-METAL SEAL SYSTEM

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

In some drilling and production systems, hangers, such as a tubing hanger, may be used to suspend strings of tubing for various flows in and out of the well. Such hangers may be disposed within a wellhead that supports both the hanger and the string. For example, a tubing hanger may be lowered into a wellhead and supported therein. To facilitate the running or lowering process, the tubing hanger may couple to a tubing hanger-running tool (THRT). Once the tubing hanger has been lowered into position within the wellhead by the THRT, a seal is formed in the gap between the spool and the hanger to block fluid flow. Unfortunately, existing systems used to seal the gap between the spool and the hanger may be complicated and time consuming.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

The disclosed embodiments include a hydrocarbon extraction system with a multi-metal seal system. In operation, the multi-metal seal system may form two axially spaced seals (e.g., annular seals) between two tubulars. The multi-metal seal system may form these two axially spaced seals using a first, a second, and a third annular metal seal portion. These metal seal portions may form first and second annular angled interfaces that expand the metal seal portions when the multi-metal seal system is energized, which forms the seal between the two tubulars. In some embodiments, the hydrocarbon extraction system may include a positive lock system that locks/holds the multi-metal seal system in place once the multi-metal seal system is energized.

Figure 1:
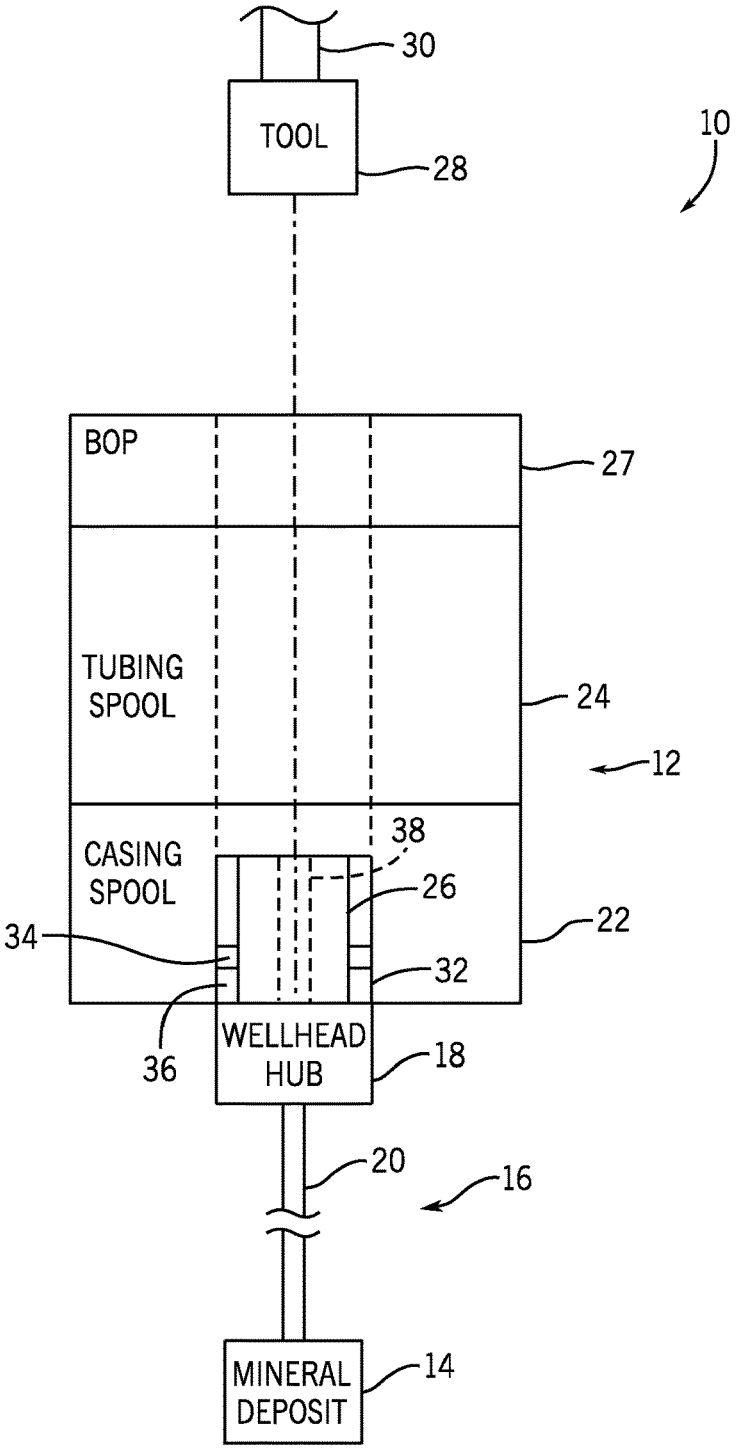
FIG. 1 is a block diagram of an embodiment of a mineral extraction system with a multi-metal seal system.

FIG. 1 is a block diagram that illustrates a hydrocarbon extraction system 10 according to an embodiment. The illustrated hydrocarbon extraction system 10 can be configured to extract various minerals and natural resources, including hydrocarbons (e.g., oil and/or natural gas), or configured to inject substances into the earth. In some embodiments, the hydrocarbon extraction system 10 is land-based (e.g., a surface system) or subsea (e.g., a subsea system). As illustrated, the hydrocarbon extraction system 10 includes a wellhead 12 coupled to a mineral deposit 14 via a well 16, wherein the well 16 includes a wellhead hub 18 and a well-bore 20.

The wellhead hub 18 generally includes a large diameter hub that is disposed at the termination of the well-bore 20. The wellhead hub 18 provides for the connection of the wellhead 12 to the well 16. The wellhead 12 typically includes multiple components that control and regulate activities and conditions associated with the well 16. For example, the wellhead 12 includes a spool 22 (e.g., tubular), a tubing spool 24 (e.g., tubular), a hanger 26 (e.g., a tubing hanger or a casing hanger), a blowout preventer (BOP) 27 and a "Christmas" tree. However, the system 10 may include other devices that are coupled to the wellhead 12, and devices that are used to assemble and control various components of the wellhead 12. For example, the hydrocarbon extraction system 10 includes a tool 28 suspended from a drill string 30. In certain embodiments, the tool 28 includes a running tool and/or a hydraulic locking/sealing tool that is lowered (e.g., run) from an offshore vessel to the well 16 and/or the wellhead 12.

As illustrated, the casing spool 22 defines a bore 32 that enables fluid communication between the wellhead 12 and the well 16. Thus, the casing spool bore 32 may provide access to the well bore 20 for various completion and workover procedures. For example, the tubing hanger 26 can be run down to the wellhead 12 and disposed in the casing spool bore 32. In operation, the hanger 26 (e.g., tubing hanger or casing hanger) provides a path (e.g., hanger bore 38) for chemical injections, etc. As illustrated, the hanger bore 38 extends through the center of the hanger 26 enabling fluid communication with the tubing spool bore 32 and the well bore 20. As will be appreciated, the well bore 20 may contain elevated pressures. Accordingly, mineral extraction systems 10 employ various mechanisms, such as seals, plugs, and valves, to control and regulate the well 16. For example, the hydrocarbon extraction system 10 may include a multi-metal seal system 34 (e.g., annular seal assembly) in a space 36 (e.g., annular region) between the tubing hanger 26 and the casing spool 22 that blocks fluid flow through the space 36.

Figure 2:
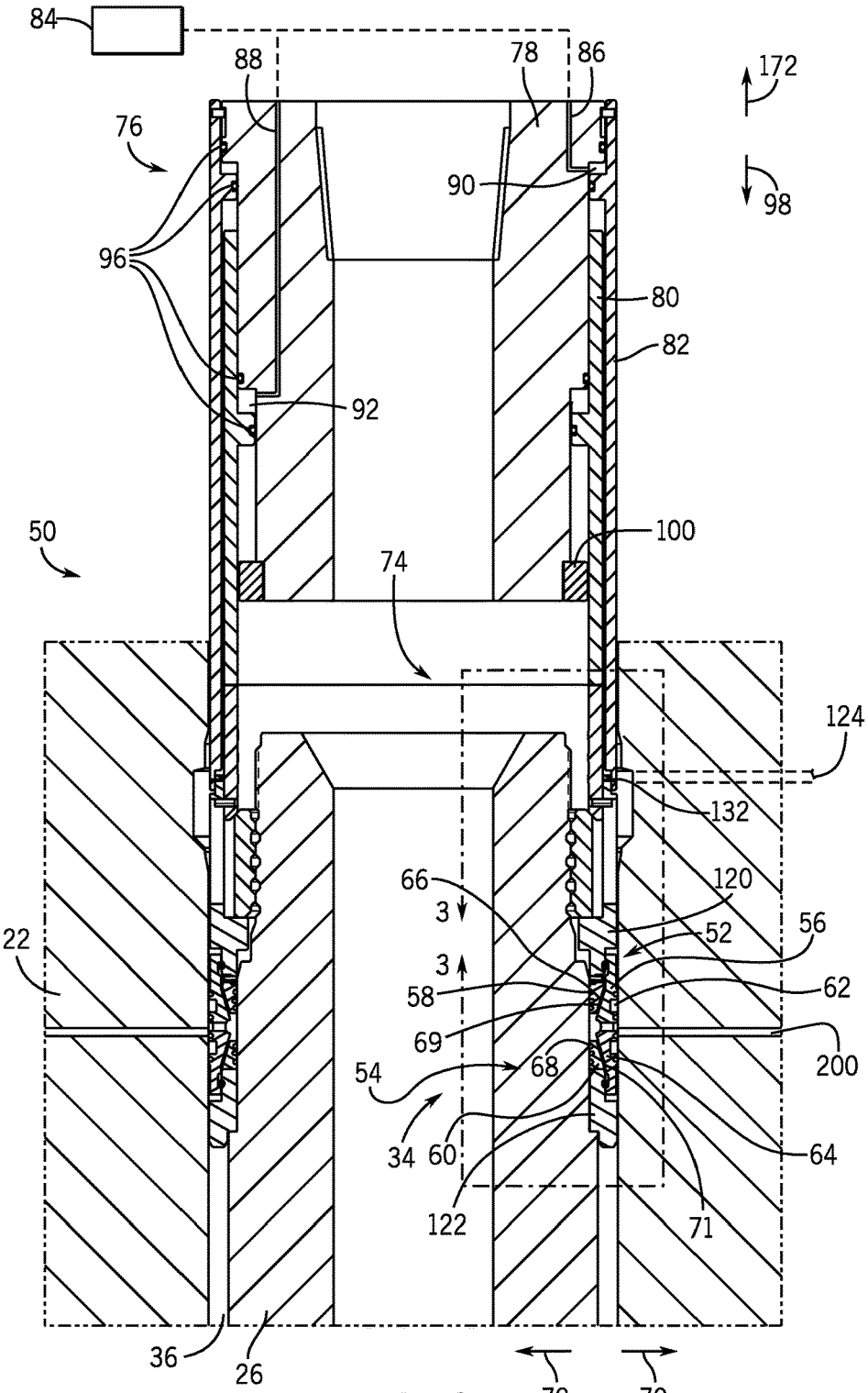
FIG. 2 is a cross-sectional side view of an embodiment of a positive lock system and an unenergized multi-metal seal system.

FIG. 2 is a cross-sectional side view of an embodiment of a positive lock system 50 and an unenergized multi-metal seal system 34. As explained above, the hydrocarbon extraction system 10 may include various seals, plugs, etc. that control the flow of fluid into and out of the well 16. For example, the hydrocarbon extraction system 10 may form a seal with the multi-metal seal system 34 in the space 36 between the tubing hanger 26 and the casing spool 22. The multi-metal seal system 34 may form first and second seals 52 and 54 (e.g., annular seals). As illustrated, the first and second seals 52, 54 are axially spaced from one another and form respective seals between the spool 22 and the hanger 26. For example, the first seal 52 is formed with a first metal seal portion 56 and a second metal seal portion 58, while the second seal 52 is formed with first metal seal portion 56 and a third metal seal portion 60. These metal seal portions 56, 58, and 60 include respective angled surfaces or faces (e.g., tapered annular surfaces) 62, 64, 66, and 68 that slide past one another. For example, the angled surfaces 62 and 66; and 64 and 68 form respective angled interfaces 69 and 71 (e.g., angled annular interfaces) that slide past each other forcing the first metal seal portion 56, the second metal seal portion 58, and the third metal seal portion 60 radially outward in directions 70 and 72 to form the first and second metal-to-metal seals 52 and 54. In some embodiments, the first and second metal-to-metal seals 52 and 54 may be held (e.g., locked) in place using the positive lock system 50.

The positive lock system 50 includes a lock ring system 74 and a tool 76 (e.g., a hydraulic tool). In operation, the tool 76 engages and energizes the multi-metal seal system 34 and the lock ring system 74 without rotating. The tool 76 includes a hydraulic body 78 surrounded by an inner annular piston cylinder 80 and an outer annular piston cylinder 82. The inner and outer annular piston cylinders 80 and 82 operate independently to axially actuate the lock ring system 74 and the multi-metal seal system 34. More specifically, as hydraulic fluid enters the hydraulic body 78, from a hydraulic fluid source 84, the fluid passes through hydraulic fluid lines 86 and 88 (e.g., internal lines) and into respective hydraulic chambers 90 and 92 (e.g., annular hydraulic chambers). The hydraulic chambers 90 and 92 are formed between the inner and outer annular piston cylinders 80 and 82 and are sealed with o-rings 96. As hydraulic fluid fills the hydraulic chambers 90 and 92, the pressure of the hydraulic fluid forces the inner and outer annular piston cylinders 80 and 82 in axial direction 98 to engage the respective lock ring system 74 and the multi-metal seal system 34. In some embodiments, the tool 76 may include a ring 100 that facilitates attachment of the inner and outer annular piston cylinders 80 and 82 to the hydraulic body 78 during assembly, but blocks separation of the inner and outer annular piston cylinders 80 and 82 once attached.

Figure 3:
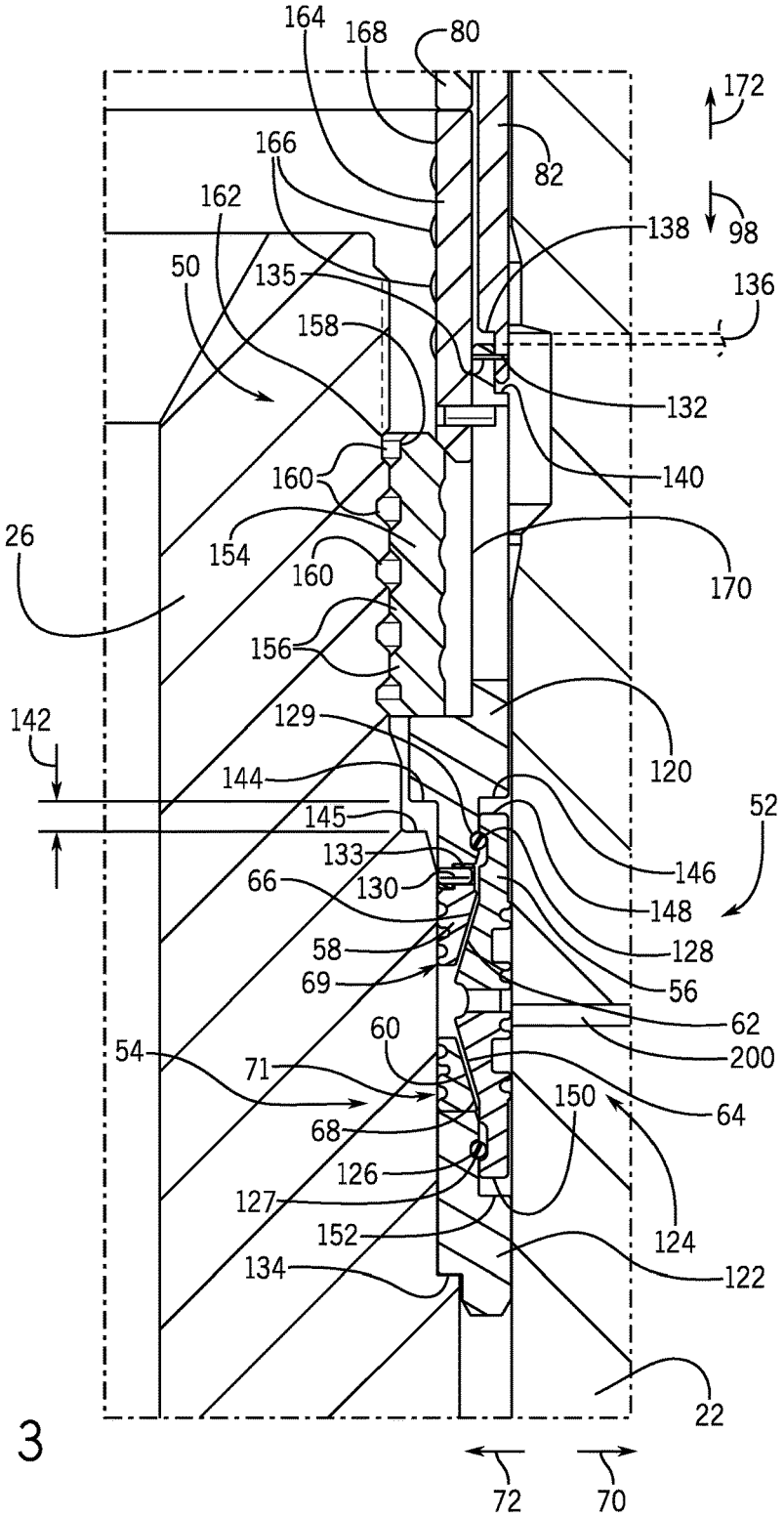
FIG. 3 is a detail view of an embodiment of the positive lock system and the unenergized multi-metal seal system within lines 3-3 of FIG. 2.

FIG. 3 is a detail view of FIG. 2 within line 3-3 illustrating an embodiment of the lock ring system 74 in an unlocked position and the multi-metal seal system 34 in an unenergized state. In some embodiments, the multi-metal seal system 34 may include a first seal sleeve 120 and a second seal sleeve 122 positioned axially above and below the first metal seal portion 56, the second metal seal portion 58, and the third metal seal portion 60. In operation, the first seal sleeve 120 and the second seal sleeve 122 facilitate compression and thereby circumferential expansion of the first, second, and third metal seal portions 56, 58, 60.

In order to lower the multi-metal seal system 34 into position, the multi-metal seal system 34 includes multiple connections 124 (e.g., pins, rings, etc.) that couple and keep the multi-metal seal system 34 together. For example, the multi-metal seal system 34 may include a first ring 126 that fits into an annular recess 127 to couple the second sleeve 122 to the first metal seal portion 56. The multi-metal seal system 34 may also include a second ring 128 that fits into an annular recess 129, and a pin 130 that fits into a radial receptacle 133, in order to couple the respective first metal seal portion 56 and second metal seal portion 58 to the first sleeve 120. The multi-metal seal system 34 may then be lowered into position with the tool 76 using a shear pin 132 that fits into a radial receptacle 135 that couples the outer sleeve 82 to the first seal sleeve 120.

In operation, the tool 76 lowers the multi-metal seal system 34 until the second sleeve 122 contacts a seal landing 134 (e.g., circumferential ledge on the hanger 26) on the tubing hanger 26. In some embodiments, the seal landing 134 may be a ledge (e.g., circumferential lip, shoulder, or abutment) formed on the casing spool 22 or another tubular within the hydrocarbon extraction system 10. After lowering the multi-metal seal system 34 and the lock ring system 74, the tool 76 activates the outer hydraulic annular piston cylinder 82 driving the outer hydraulic annular piston cylinder 82 an axial distance 136. As the outer hydraulic annular piston cylinder 82 moves the axial distance 136, the outer hydraulic annular piston cylinder 82 shears through the shear pin 132, enabling the lower surface 138 of the outer hydraulic annular piston cylinder 82 to contact the upper surface 140 of the first seal sleeve 120. Once in contact, the outer hydraulic annular piston cylinder 82 drives the first seal sleeve 120 in axial direction 98 an axial distance 142 until a lip 144 (e.g., annular lip) on the first seal sleeve 120 contacts a ledge 145 (e.g., annular ledge) on the tubing hanger 26.

As the first sleeve 120 moves axially in direction 98, the first seal sleeve 120 axially drives the second metal seal portion 58 as well as the first metal seal portion 56. For example, the first seal sleeve 120 uses a ledge 146 (e.g., circumferential ledge) to contact a top surface 148 of the first metal seal portion 56 driving the first metal seal portion 56 in axial direction 98. The movement of the first metal seal portion 56 in axial direction 98 drives the angled surface 64 on the first metal seal portion 56 into contact with the angled surface 68 on the third metal seal portion 60. As the angled surface 64 slides over the angled surface 68, the angled interface 71 drives the first metal seal portion 56 radially outward in radial direction 70 and drives the third metal seal portion 60 radial inward in radial direction 72 to form the second seal 54 between the casing spool 22 and the hanger 26. While the second seal 54 forms, the first seal sleeve 120 continues to move in axial direction 98 driving the first metal seal portion 56 and the second metal seal portion 58 in axial direction 98. Eventually, the first metal seal portion 56 stops moving in axial direction 98 because of compression between the first metal seal portion 56 and the third metal seal portion 60 or contact between a bottom surface 150 and ledge 152 on the second seal sleeve 122. Once the first metal seal portion 56 stops moving, the first seal sleeve 120 is able to drive the angled surface 66 of the second metal seal portion 58 into contact with the angled surface 62 on the first metal seal portion 56. As the angled surface 66 slides past the angled surface 62, the angled interface 69 drives the first metal seal portion 56 radially outward in radial direction 70 and drives the second metal seal portion 58 radially inward in radial direction 72 to form the first seal 52 between the casing spool 22 and the hanger 26.

While the first seal sleeve 120 forms the first and second seals 52, 54, the axial movement of the first seal sleeve 120 in axial direction 98 aligns a load ring 154 with the tubing hanger 26. For example, the first radial lock feature on the load ring 154 (e.g., c-ring) may include multiple protrusions and recesses (e.g., axially spaced annular protrusions or teeth) on a surface 158 that correspond to the second radial lock feature 160 (e.g., axially spaced annular recesses) on a surface 162 of the tubing hanger 26. Accordingly, movement of the first seal sleeve 120 in axial direction 98 enables the first radial lock feature 156 to align with the second radial lock feature 160 while simultaneously energizing the multi-metal seal system 34.

In order to maintain the multi-metal seal system 34 in an energized state, the inner hydraulic annular piston cylinder 80 drives the lock ring system 74 into a locked position without rotation. The lock ring system 74 includes the load ring 154 and a lock ring 164. In operation, the load ring 154 couples to the tubing hanger 26 in order to resist movement of the multi-metal seal system 34. Specifically, the first radial lock feature 156 on the surface 158 resist axial movement after engaging the second radial lock feature 160 on surface 162 of the tubing hanger 26. In order to maintain engagement between the load ring 154 and the tubing hanger 26, the hydraulic tool 76 axially drives the lock ring 164 behind the load ring 154 (e.g., in an axially overlapping relationship). In some embodiments, the lock ring 164 may include protrusions 166 (e.g., axially spaced annular protrusions or teeth) on a surface 168 that may remove a gap between the surfaces 168 and 170 as well as increase pressurized contact between the lock ring 164 and the load ring 154, which resists movement of the lock ring 164 in direction 98 or 172. In other embodiments, the load ring 154 may include the protrusions 166 on the surface 170 to increase pressurized contact between the lock ring 164 and the load ring 154.

Figure 4:
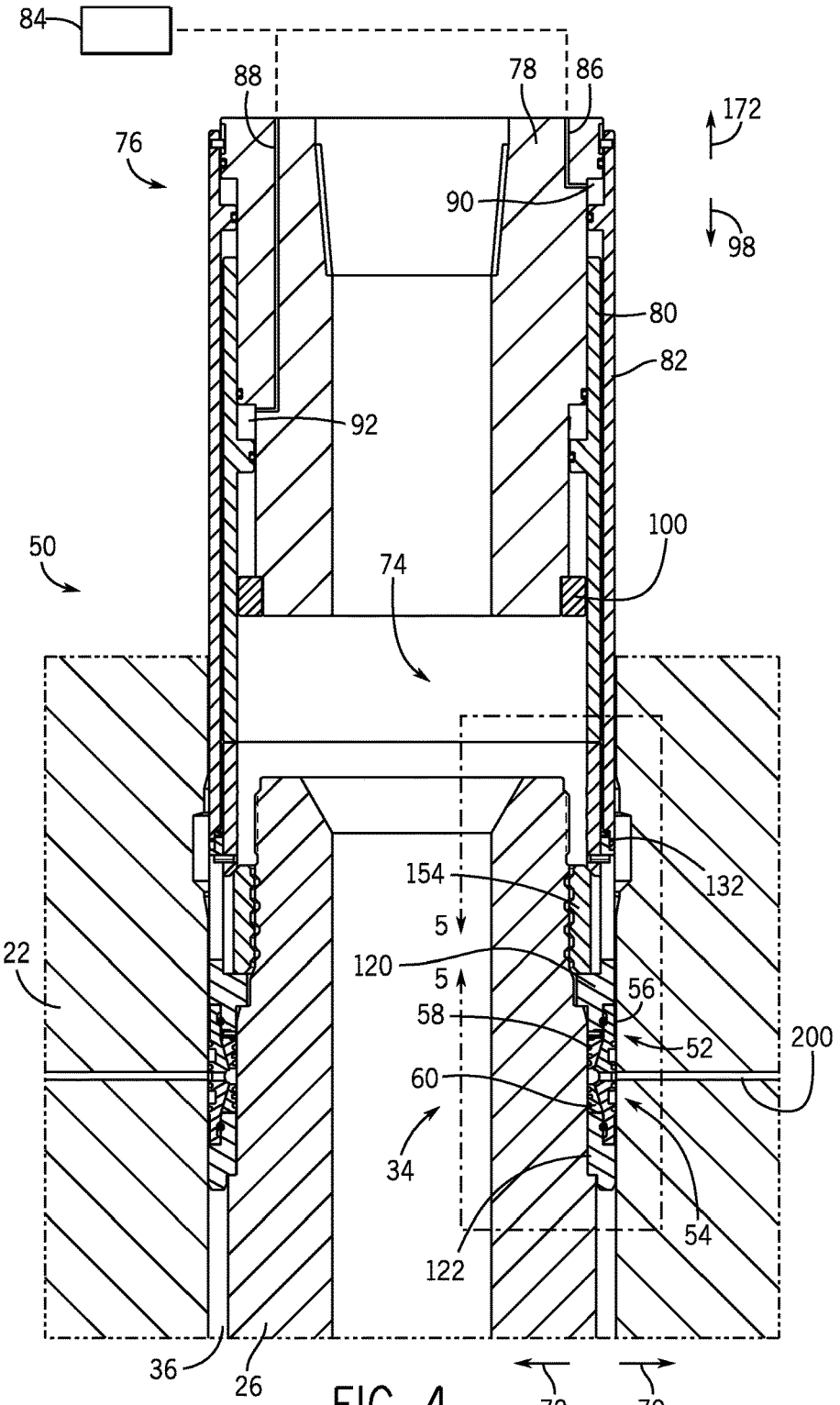
FIG. 4 is a cross-sectional side view of an embodiment of a positive lock system and an energized multi-metal seal system.

FIG. 4 is a cross-sectional side view of the tool 76 energizing the multi-metal seal system 34. As explained above, in order to energize the multi-metal seal system 34, the tool 76 pumps hydraulic fluid from an external source through the hydraulic line 86 and into the hydraulic chamber 90. As the hydraulic fluid fills the hydraulic chamber 90, the pressure of the fluid drives the outer hydraulic annular piston cylinder 82 axially downward in direction 98. The movement of the outer hydraulic annular piston cylinder 82 in direction 98 enables the outer hydraulic annular piston cylinder 82 to energize the multi-metal seal system 34.

Figure 5:
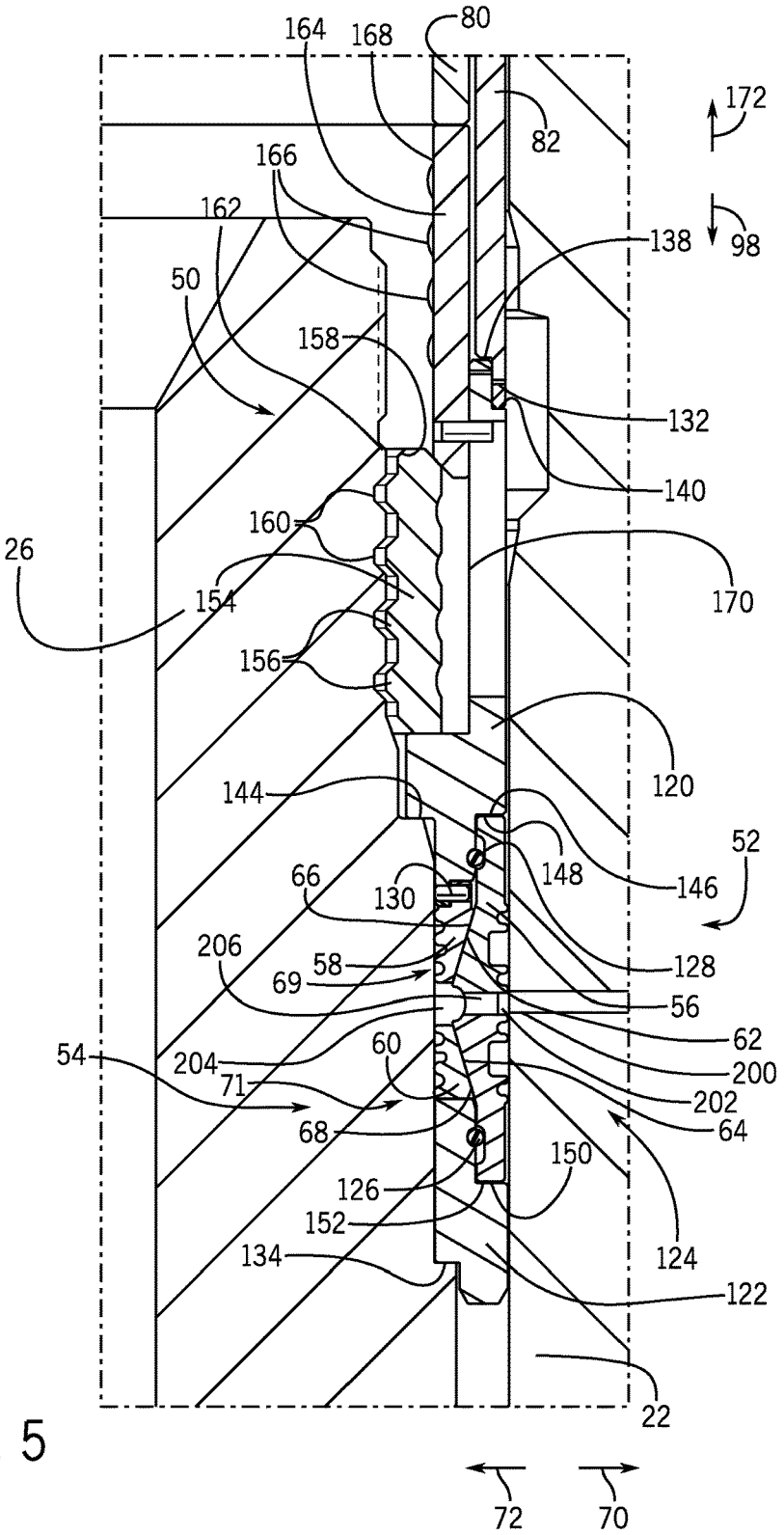
FIG. 5 is a detail view of an embodiment of the positive lock system and the energized multi-metal seal system within lines 5-5 of FIG. 4.

FIG. 5 is a detail view of FIG. 4 within line 5-5 illustrating the multi-metal seal system 34 in an energized state. As explained above, the tool 76 activates the outer hydraulic annular piston cylinder 82 axially driving the outer hydraulic annular piston cylinder 82 the distance 136 to shear through the shear pin 132. After shearing through the shear pin 132, the lower surface 138 of the outer hydraulic annular piston cylinder 82 contacts the upper surface 140 of the first seal sleeve 120. Once in contact, the outer hydraulic annular piston cylinder 82 drives the first seal sleeve 120 in direction 98. As the first seal sleeve 120 moves in direction 98, the first seal sleeve 120 drives the first metal seal portion 56 and the second metal seal portion 58 to form the first seal 52 and the second seal 54. As explained above, the angled interfaces 69 and 71 enable the first metal seal portion 56 to move radially outward in radial direction 70, while the second and third metal seal portions 58, 60 move radially inward in radial direction 72. Furthermore, as the first seal sleeve 120 moves in direction 98, the load ring 154 aligns with the tubing hanger 26. As explained above, the load ring 154 may include the first radial lock feature 156 that enable the load ring 154 to couple (e.g., lock) to the tubing hanger 26. Accordingly, as the first seal sleeve 120 moves in axial direction 98, the first radial lock feature 156 on the load ring 154 aligns with the second radial lock feature 160 on the hanger 26.

Once the first and second seals 52, 54 are set, fluid may be pumped through a passage 200 (e.g., test port) in the casing spool 22 to test the first and second seals 52, 54. In operation, a pressurized fluid is pumped through the casing spool 22 and into first and second seal test chambers 202, 204 to check for proper sealing of the first, second, and third metal seal portions 56, 58, 60. In some embodiments, the first metal seal portion 56 may include an aperture 206 that connects the first and second seal test chambers 202, 204, enabling a single passage 200 (e.g., test port) to test the multi-metal seal system 34.

Figure 6:
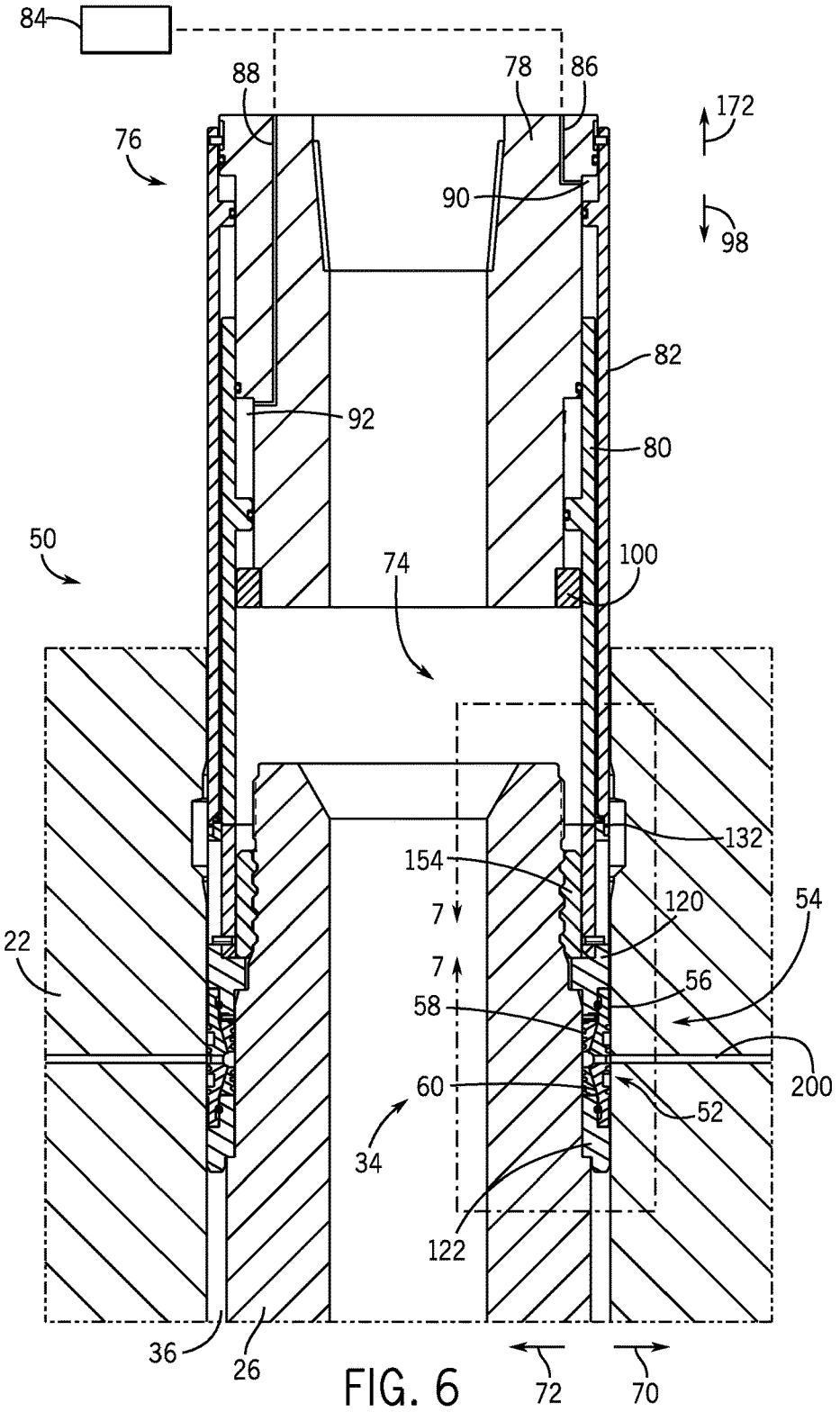
FIG. 6 is a cross-sectional side view of an embodiment of a positive lock system in a locked position and an energized multi-metal seal system.

FIG. 6 is a cross-sectional view of an embodiment of an energized lock ring system 74. In order to energize the lock ring system 74, the tool 76 pumps hydraulic fluid from an external source through the hydraulic line 88 and into the hydraulic chamber 92. As the hydraulic fluid fills the hydraulic chamber 92, the pressure of the hydraulic fluid drives the inner hydraulic annular piston cylinder 80 axially downward in direction 98. The vertical movement of the inner hydraulic annular piston cylinder 80 in direction 98 enables the tool 76 to energize the lock ring system 74 with the lock ring 164, which maintains the multi-metal seal system 34 in a sealed position.

Figure 7:
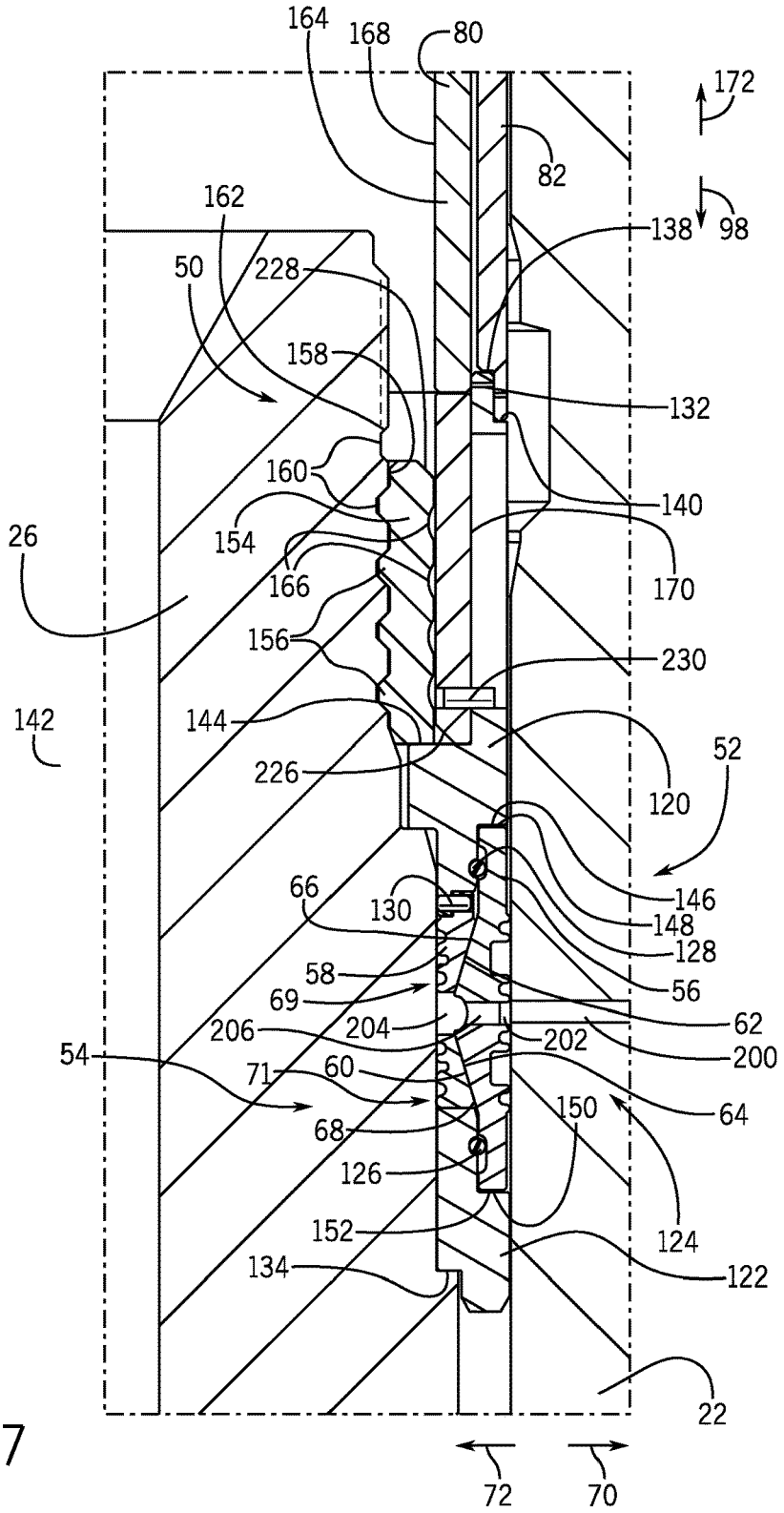
FIG. 7 is a detail view of an embodiment of the positive lock system in the locked position and the energized multi-metal seal system within lines 7-7 of FIG. 6.

FIG. 7 is a detail view of FIG. 6 within line 7-7 of an embodiment of the energized lock ring system 74. As explained above, the lock ring system 74 includes the load ring 154 and the lock ring 164. In operation, the load ring 154 couples to the tubing hanger 26 in order to resist movement of the multi-metal seal system 34. In order to maintain engagement between the load ring 154 and the tubing hanger 26, the hydraulic tool 76 drives inner hydraulic annular piston cylinder 80 in substantially direction 98, which moves the lock ring 164 circumferentially behind the load ring 154 (e.g., axially overlapping). More specifically, as the lock ring 164 moves in substantially direction 98, an angled contact surface 226 (e.g., tapered annular surface) on the lock ring 164 contacts a corresponding angled surface 228 (e.g., tapered annular surface) on the load ring 154. The contact between the two angled surfaces 226 and 228 forces the load ring 154 radially inward, which couples the load ring 154 to the hanger 26. As explained above, the load ring 154 may couple to the tubing hanger 26 with a first radial lock feature 156 which includes protrusions and recesses on the surface 158 that correspond to a second radial lock feature 160 which includes protrusions and recesses on the surface 162 of the tubing hanger 26. After coupling the load ring 154 to the tubing hanger 26, the inner hydraulic annular piston cylinder 80 will continue driving the lock ring 164 in axial direction 98 until the bottom surface 164 of the lock ring 164 contacts a top surface 166 of the first seal sleeve 120. In this position, the lock ring 164 blocks radial movement of the load ring 154, while the first radial lock feature 156 on the load ring block/resist axial movement in direction 168, which maintains the multi-metal seal system 34 in a sealed position. In some embodiments, a guide pin 230 may couple the lock ring 164 to the first seal sleeve 120. In operation, the guide pin 230 couples the lock ring system 74 to the multi-metal seal system 34 during insertion, and aligns (e.g., axially guides) the lock ring 164 as the inner hydraulic annular piston cylinder 80 axially drives the lock ring 164. Furthermore, in some embodiments, the lock ring 164 may include protrusions 166 on the surface 168. These protrusions 166 may increase pressurized contact between the lock ring 164 and the load ring 154 to resist axial movement of the lock ring 164 in direction 168.

Figure 8:
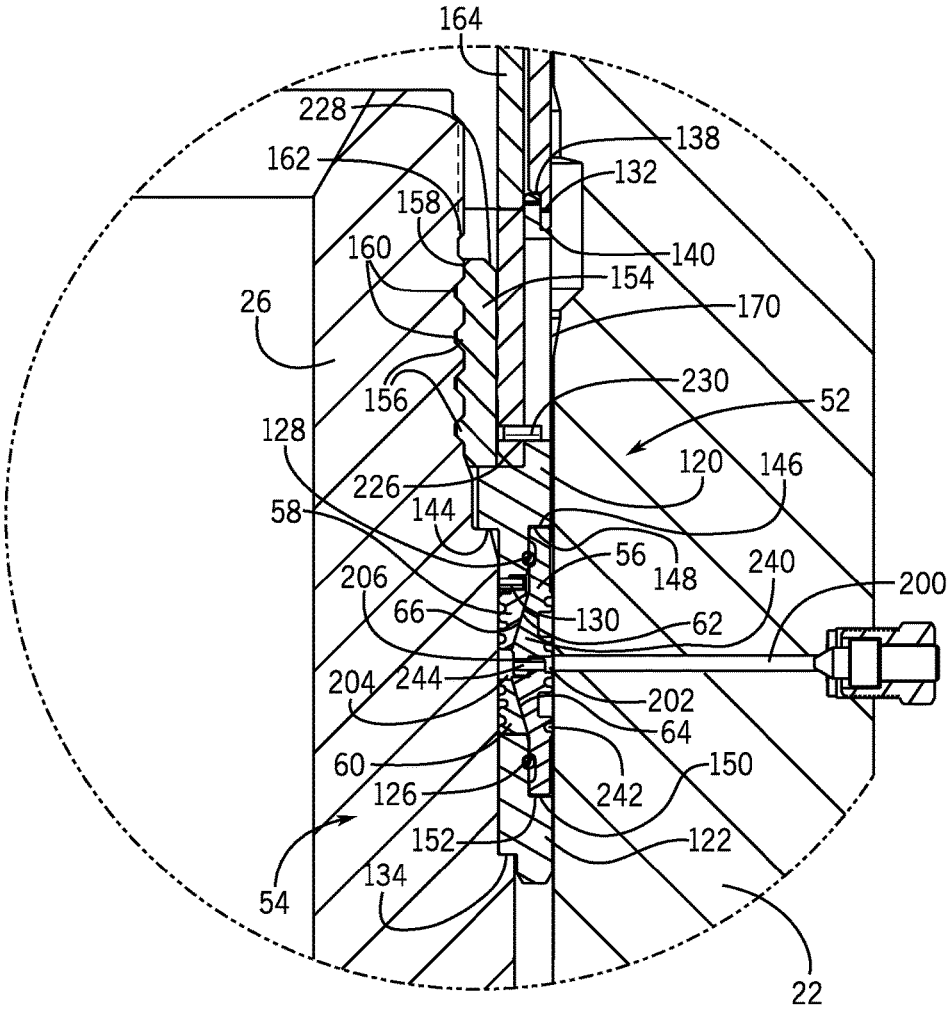
FIG. 8 is a cross-sectional side view of an embodiment of a lock ring system and a multi-metal seal system.

FIG. 8 is a cross-sectional view of an embodiment of the positive lock system 68 and the multi-metal seal system 34 in an energized state. As explained above, the multi-metal seal system 34 may include a first seal portion 56, a second seal portion 58, and a third seal portion 60. In some embodiments, the first seal portion 56 may include a first member 240 (e.g., annular seal portion) and a second member 242 (e.g., annular seal portion). The first and second members 240, 242 may couple together with a pin 244 (e.g., radial pin) or another mechanical connection to facilitate insertion and extraction of the first seal portion 56. In some embodiments, the pin 244 may be hollow or include an aperture 206 that enables pressurized fluid to test the first and second seals 52, 54. As explained above, a pressurized fluid may be pumped through the casing spool 22 and into the first and second seal test chambers 202, 204 to test sealing.

Figure 9:
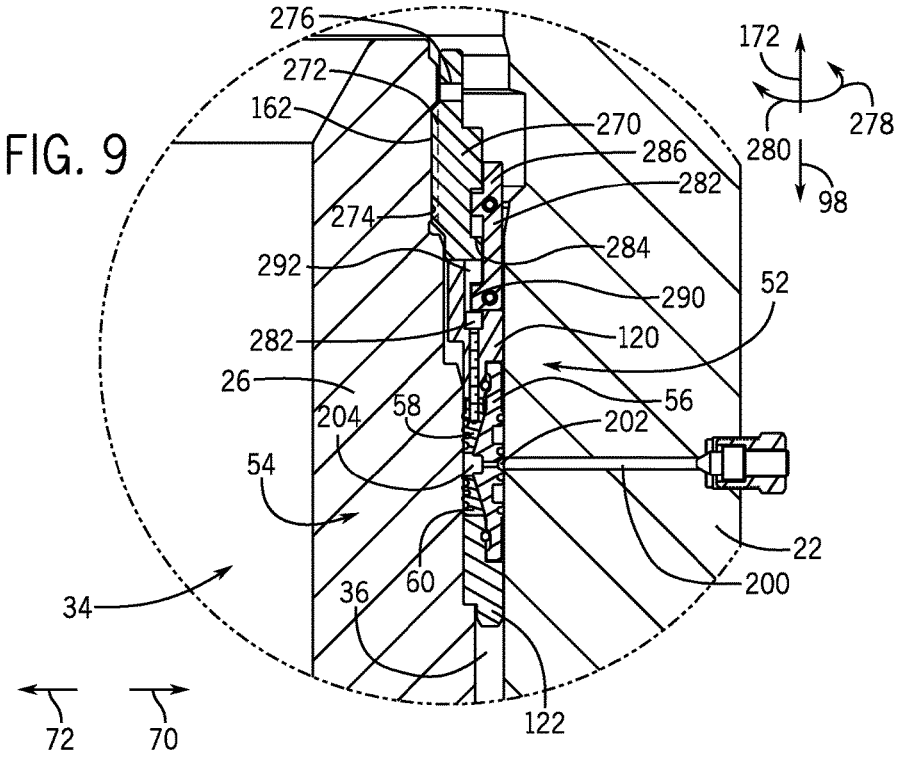
FIG. 9 is a cross-sectional side view of an embodiment of a multi-metal seal system.

FIG. 9 is a cross-sectional side view of an embodiment of a multi-metal seal system 34 manually actuated by threading a ring 270 onto the hanger 26. As illustrated, the ring 270 includes threads 272 that engage corresponding threads 274 on an exterior surface 162 of the hanger 26. The ring 270 may also include an aperture 276 that couples the ring 270 to a tool (e.g., tool 28). In operation, the tool 28 rotates the ring 270 in either circumferential direction 278 or 280 to thread the ring 270 onto the hanger 26. As the ring 270 threads onto the hanger 26, the ring 270 moves progressively in axial direction 98, driving the first seal sleeve 120 in axial direction 98. As explained above, as the first seal sleeve 120 moves in axial direction 98, the first seal sleeve 120 drives the first metal seal portion 56 and the second metal seal portion 58 to form the first seal 52 and the second seal 54. Specifically, the angled interfaces 69 and 71 enable the first metal seal portion 56 to move radially outward in radial direction 70, while the second and third metal seal portions 58, 60 move radially inward in radial direction 72.

Once the first and second seals 52, 54 are set, fluid may be pumped through a passage 200 (e.g., test port) in the casing spool 22 to test the first and second seals 52, 54. In operation, a pressurized fluid is pumped through the casing spool 22 and into first and second seal test chambers 202, 204 to check for proper sealing of the first, second, and third metal seal portions 56, 58, 60. In some embodiments, the first metal seal portion 56 may include an aperture 206 that connects the first and second seal test chambers 202, 204, enabling a single passage 200 (e.g., test port) to test the multi-metal seal system 34.

In order to extract the multi-metal seal system 34, the second metal seal portion 58 may include a connector 282 (e.g., a threaded connector, screw, bolt, etc.) that couples the first seal sleeve 120 to the second metal seal portion 58. In operation, the connector 282 facilitates extraction of the seal system 34 when the ring 270 unthreads from the hanger 26 in direction 172. For example, as the ring 270 unthreads from the hanger 26, the ring 270 moves in axial direction 172. As the ring 270 moves in axial direction 172, a ledge 284 on the ring 270 contacts a first protrusion 286 on a retraction member 288, enabling the ring 270 to pull the retraction member 288 in axial direction 172. As the retraction member 288 moves in axial direction 172, a second protrusion 290 contacts a ledge 292 on the first seal sleeve 120 pulling the first seal sleeve 120 in axial direction 172. As the first seal sleeve 120 moves in axial direction 172, the connector 282 pulls the second metal seal portion 58 in axial direction 172 enabling retraction of the multi-metal seal system 34.

Figure 10:
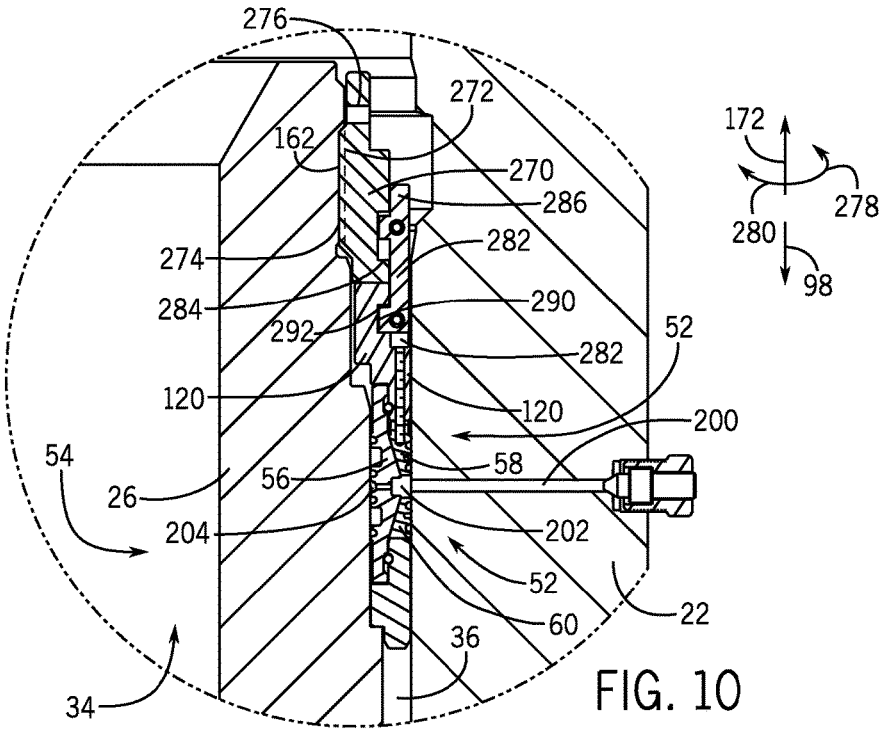
FIG. 10 is a cross-sectional side view of an embodiment of a multi-metal seal system.

FIG. 10 is a cross-sectional side view of an embodiment of a multi-metal seal system 34. As illustrated, the first, second, and third metal seal portions 56, 58, 60 may be interchangeable placed within the space 36. For example, the first metal seal portion 56 may contact and form a seal with the hanger 26 or the casing spool 22. Likewise, the second and third metal seal portions 58, 60 may contact either the hanger 26 or the casing spool 22 in order to form the first and second seals 52, 54.

Figure 11:
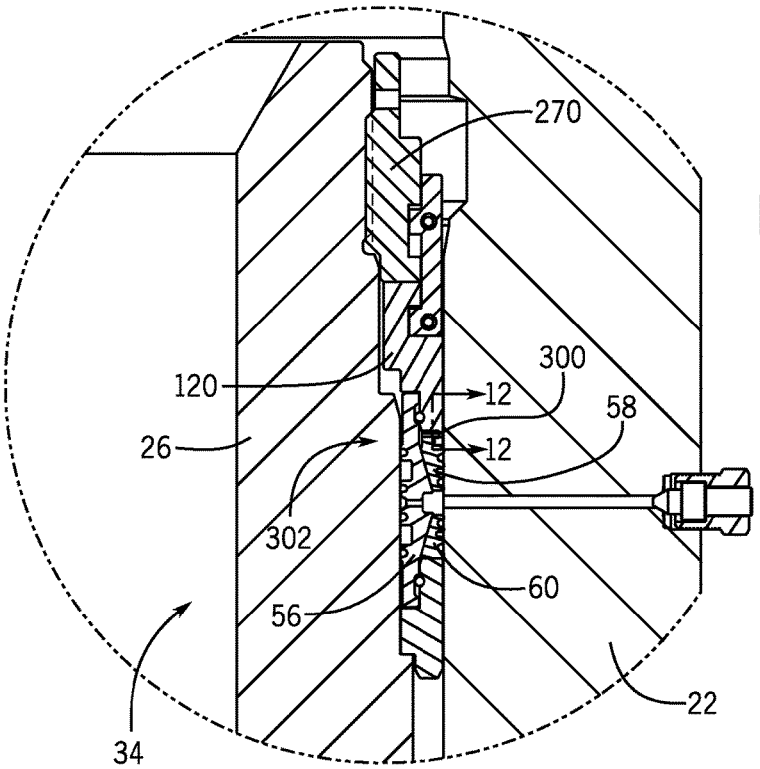
FIG. 11 is a cross-sectional side view of an embodiment of a multi-metal seal system.
Figure 12:
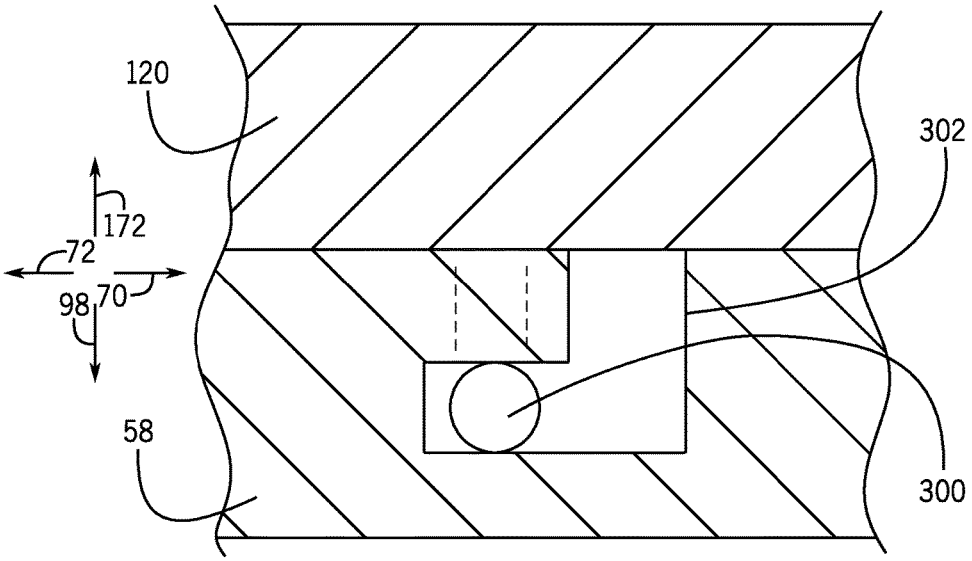
FIG. 12 is a sectional view of an embodiment of the multi-metal seal system along lines 12-12 of FIG. 11.

FIG. 11 is a cross-sectional side view of an embodiment of a multi-metal seal system 34. In FIG. 11, the first seal sleeve 120 couples to the second metal seal portion 58 with a pin 300 that rests within a slot 302 (e.g., L-slot) in the second metal seal portion 58. The pin 300 enables the first seal sleeve 120 to retract the second metal seal portion 58 and thereby retract the multi-metal seal system 34. The pin 300 and slot 302 may also reduce or block rotation of the second metal seal portion 58, which blocks or reduces rotation of the multi-metal seal system 34. For example, FIG. 12 illustrates the pin 300 on the first seal sleeve 120 coupled to an L-slot 302 on the second metal seal portion 58. In some embodiments, the second metal seal portion 58 may include the pin 300 and the first seal sleeve 120 includes the L-slot 302.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system, comprising:

a first tubular;

a second tubular, wherein the first and second tubulars are configured to be disposed one inside another about an axis;

a multi-metal seal system configured to seal an annular space between a first surface of the first tubular and a second surface of the second tubular, wherein the multimetal seal system comprises:

a first metal seal portion with a first angled surface and a second angled surface;

a second metal seal portion with a third angled surface; and a third metal seal portion with a fourth angled surface;

wherein the first angled surface selectively engages the third angled surface at a first angled interface and the second angled surface selectively engages the fourth angled surface at a second angled interface, and wherein the first and second angled interfaces are configured to drive the first metal seal portion only in a first radial direction relative to the axis and seal radially against the first surface, drive the second metal seal portion only in a second radial direction relative to the axis and seal radially against the second surface, and drive the third metal seal portion only in the second radial direction relative to the axis and seal radially against the second surface.

2. The system of claim 1, wherein the multi-metal seal system forms a first fluid chamber between the first metal seal portion and the first surface of the first tubular, the multi-metal seal system forms a second fluid chamber axially between the second and third metal seal portions and radially between the first metal seal portion and the second surface of the second tubular, and the first metal seal portion comprises a passage configured to enable fluid to flow between the first and second fluid chambers.

3. The system of claim 2, comprising a seal test passage fluidly coupled to the first fluid chamber, the second fluid chamber, and the passage, wherein the seal test passage is configured to supply a fluid to test the first, second, and third metal seal portions.

4. The system of claim 1, wherein the first metal seal portion has a radial thickness that increases along the first metal seal portion as the first and second angled surfaces extend axially toward one another between opposite axial ends of the first metal seal portion, and the second and third metal seal portions are driven to seal radially against the second surface as the second and third metal seal portions are driven to move axially toward one another while the third and fourth angled surfaces slide along the respective first and second angled surfaces.

5. The system of claim 1, comprising a first seal sleeve configured to couple to the first and second metal seal portions.

6. The system of claim 5, comprising a second seal sleeve configured to support the first and third metal seal portions.

7. The system of claim 5, wherein the first seal sleeve couples to the second metal seal portion with a threaded connector or a pin.

8. The system of claim 1, wherein the first metal seal portion seals radially against only the first surface and not the second surface, the second metal seal portion seals radially against only the second surface and not the first surface, and the third metal seal portion seals radially against only the second surface and not the first surface.

9. The system of claim 1, comprising a hydrocarbon extraction system with a hydraulic tool configured to actuate the multi-metal seal system.

10. The system of claim 1, comprising a lock ring system configured to block movement of the multi-metal seal system.

11. The system of claim 10, wherein the lock ring system comprises a load ring configured to move in a radial direction between a first position that allows movement of the multi-metal seal system and a second position that blocks movement of the multi-metal seal system, and a lock ring configured to radially energize the load ring to move from the first position to the second position by moving only in an axial direction, wherein the lock ring is configured to hold the load ring in the second position.

12. A system, comprising:

a multi-metal seal system configured to seal an annular space between a first surface of a first tubular and a second surface of a second tubular, wherein the multimetal seal system comprises:

a first metal seal portion with a first angled surface and a second angled surface;

a second metal seal portion with a third angled surface; and a third metal seal portion with a fourth angled surface;

wherein the first angled surface selectively engages the third angled surface at a first angled interface and the second angled surface selectively engages the fourth angled surface at a second angled interface, and wherein the first and second angled interfaces are configured to drive the first metal seal portion radially away from the second surface and seal radially against the first surface, drive the second metal seal portion radially away from the first surface and seal radially against the second surface, and drive the third metal seal portion radially away from the first surface and seal radially against the second surface; and a lock ring system configured to hold the multi-metal seal system in a sealed position, wherein the lock ring system comprises:

a load ring configured to engage the first tubular; and a lock ring configured to radially energize the load ring by moving only in an axial direction.

13. The system of claim 12, wherein the multi-metal seal system comprises a first seal sleeve configured to couple to the first and second metal seal portions and energize the multi-metal seal system by moving axially.

14. The system of claim 13, comprising a second seal sleeve configured to support the first and third metal seal portion while the first seal sleeve moves axially.

15. The system of claim 12, comprising a hydrocarbon extraction system with a hydraulic tool configured to actuate the multi-metal seal system and the lock ring system.

16. A system, comprising:

a multi-metal seal system configured to seal an annular space about an axis and between a first surface of a first tubular and a second surface of a second tubular, wherein the multi-metal seal system comprises:

a first metal seal portion with a first angled surface and a second angled surface;

a second metal seal portion with a third angled surface; and a third metal seal portion with a fourth angled surface;

wherein the first angled surface selectively engages the third angled surface at a first angled interface and the second angled surface selectively engages the fourth angled surface at a second angled interface, and wherein the first and second angled interfaces are configured to drive the first metal seal portion radially away from the second and third metal seal portions to seal the annular space between the first and second tubulars by driving the first metal seal portion only in a first radial direction relative to the axis to seal radially against the first surface, driving the second metal seal portion only in a second radial direction relative to the axis to seal radially against the second surface, and driving the third metal seal portion only in the second radial direction relative to the axis to seal radially against the second surface.

17. The system of claim 16, wherein the multi-metal seal system comprises a first seal sleeve configured to couple to the first and second metal seal portions and energize the multi-metal seal system by moving axially.

18. The system of claim 17, comprising a second seal sleeve configured to support the first and third metal seal portion while the first seal sleeve moves axially.

19. The system of claim 16, comprising a hydrocarbon extraction system with a hydraulic tool configured to actuate the multi-metal seal system.

20. The system of claim 16, comprising a lock ring system configured to block movement of the multi-metal seal system.

* * * * *